US008113382B1

(12) United States Patent
Piersant et al.

(10) Patent No.: US 8,113,382 B1
(45) Date of Patent: Feb. 14, 2012

(54) BOTTLED WATER CENTER

(75) Inventors: Rodger Piersant, Dalton, GA (US); Richie Morrison, Dalton, GA (US); Andy Michaud, Dalton, GA (US); Jim Gibbons, Dalton, GA (US)

(73) Assignee: DS Waters of America, Inc., Atlanta, GA (US)

( * ) Notice: Subject to any disclaimer, the term of this patent is extended or adjusted under 35 U.S.C. 154(b) by 333 days.

(21) Appl. No.: 12/492,854

(22) Filed: Jun. 26, 2009

(51) Int. Cl.
*A47F 1/00* (2006.01)

(52) U.S. Cl. ..... 221/102; 221/66; 221/151; 221/156; 221/97

(58) Field of Classification Search ..... None
See application file for complete search history.

(56) References Cited

U.S. PATENT DOCUMENTS 3,179,224 A * 4/1965 Haupt, Sr. et al. ..... 194/226
4,207,973 A 6/1980 Stampleman
4,573,641 A 3/1986 DeWoolfson et al.
4,717,026 A 1/1988 Fischer et al.
4,919,274 A 4/1990 Hammond
5,161,661 A 11/1992 Hammond
5,355,987 A 10/1994 DeWoolfson et al.
5,361,913 A 11/1994 Melchionna
5,829,630 A * 11/1998 Fernald ..... 221/66
6,192,296 B1 * 2/2001 Colmant et al. ..... 700/237
6,206,237 B1 * 3/2001 Dillon et al. ..... 221/289
6,834,691 B2 * 12/2004 Goldin ..... 141/364
D566,920 S 4/2008 Boydston et al.
7,909,206 B2 * 3/2011 Davis, Jr. ..... 221/102
7,975,875 B2 * 7/2011 Borzym ..... 221/66
2007/0012541 A1 1/2007 Boydston et al.
2008/0121492 A1 5/2008 Kreitz et al.
2008/0308383 A1 12/2008 Boydston et al.

* cited by examiner

*Primary Examiner* — Timothy Waggoner
(74) *Attorney, Agent, or Firm* — Perkins Coie LLP

(57) ABSTRACT

A bottle return station preferably with a dispensing station provides for the receipt of empty bottles. Bottles are provided through an acceptor which accepts bottles having a particular configuration while not accepting others. The empty bottle returns are guided to a receiving station where they can be retrieved by an operator. Meanwhile a dispensing station can be accessed by users.

16 Claims, 3 Drawing Sheets

BOTTLED WATER CENTER

FIELD OF THE INVENTION

The present invention relates to a kiosk or center configured to retrieve water bottles in a presently preferred embodiment, and possibly dispense water bottles as well.

BACKGROUND OF THE INVENTION

U.S. Pat. No. D566,920 owned by Prima Water Corporation of Winston Salem, N.C., is directed to a bottle return apparatus which is configured to receive empty bottles in a cage until picked up by an operator. This bin is believed to be configured to dispense a ticket to a customer for the customer to take to the checkout counter for credit in redeeming the empty bottle. While this is certainly one way of conducting water bottle business, there is believed to be room for improvement in the water bottle exchange business.

SUMMARY OF THE INVENTION

The present invention relates to equipment utilized with bottle supply and/or return systems.

An object of many embodiments of the present invention relates to an improved bottle return center.

Another object of many embodiments of the present invention relates to an improved bottle supply center.

Another object of many embodiments of the present invention is to provide an improved water bottle return system although similar technology could be applied to the propane bottle supply and return industry as well.

Another object of many embodiments the present invention is to provide an improved method of receiving empty bottles such as water bottles.

Another object of the presently preferred embodiment of the present invention is to provide an improved organizational system for storing empty bottles while potentially allowing or providing access, such as selected access to filled bottles.

It is another object of many embodiments of the present invention to provide for an improved water bottle center for dispensing and/or receiving water bottles.

Accordingly, in the presently preferred embodiment of the present invention, a bottle center or kiosk is provided with a return station in which an empty bottle is placed at an elevation at a return acceptor. Once admitted through the acceptor, the bottle is preferably guided with guides taking into consideration circular cross sectional portions of the exterior of the bottle to assist in directing the bottle in a designed manner with gravity assisting in feeding the return toward a removal location. As more bottles are placed through the return acceptor location, then the bottles preferably stack sequentially beginning at the return retrieval location.

Furthermore, in the preferred embodiment, the return axis location is provided with an interlock at the acceptor which can block the insertion of return bottles not oriented in a desired position and having a desired cross sectional perimeter. This interlock also may prevent unauthorized removal of bottles which have been inserted.

In still other embodiments, in addition to a retrieval system, a distribution station is provided which filled bottles are available for purchase are presented preferably in an orderly fashion for purchase by consumers. These bottles may, or may not, be preferably oriented so that they will not roll from one position to another.

One or more processors can be coordinated with sensors and/or switches to ascertain the position of at least some of the bottles such as to detect removal and/or stocking issues. The electronic components can be coordinated with at least one processor in order to make a water center which is a point of purchase sale center such as by receiving credit card payment to then possibly allow the removal of particular bottles. Still other embodiments may detect a return and possibly discount the price for a full bottle and/or identify when a number of the initial supply is depleted therefore advising an operator of a need to restock the supply.

The electronic version could also effectively count the number of retrieved bottles to identify when the center needs to be cleared to have at least some of the return bottles removed from the station.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
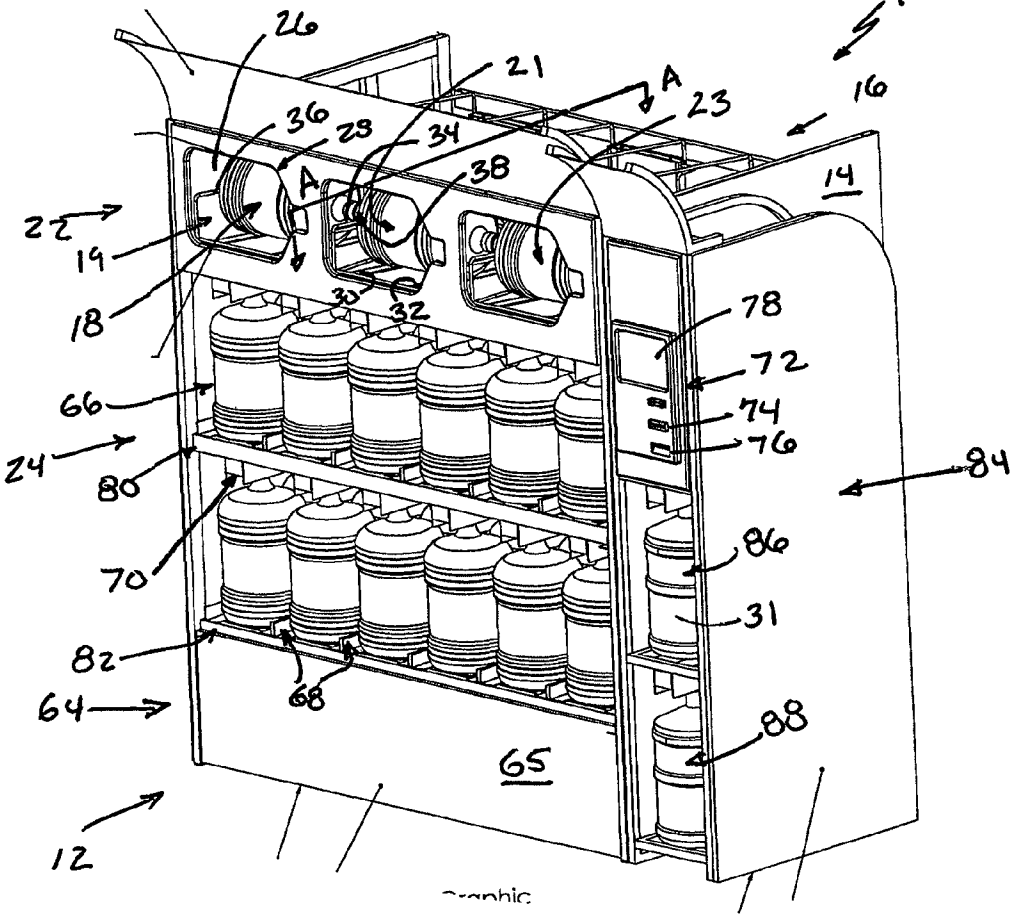
FIG. 1 is a front perspective view of a kiosk constructed in accordance with the presently preferred embodiment of the present invention.
Figure 3:
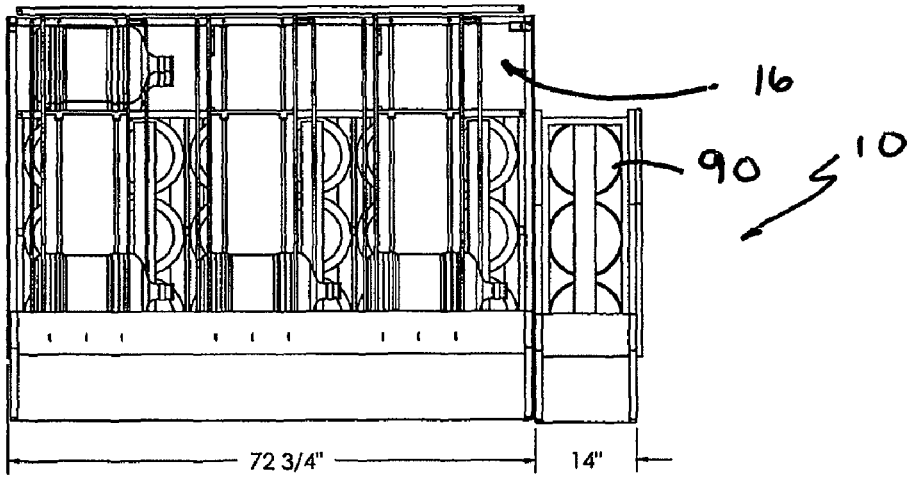
FIG. 3 is a back view of the kiosk of FIG. 1.
Figure 4:
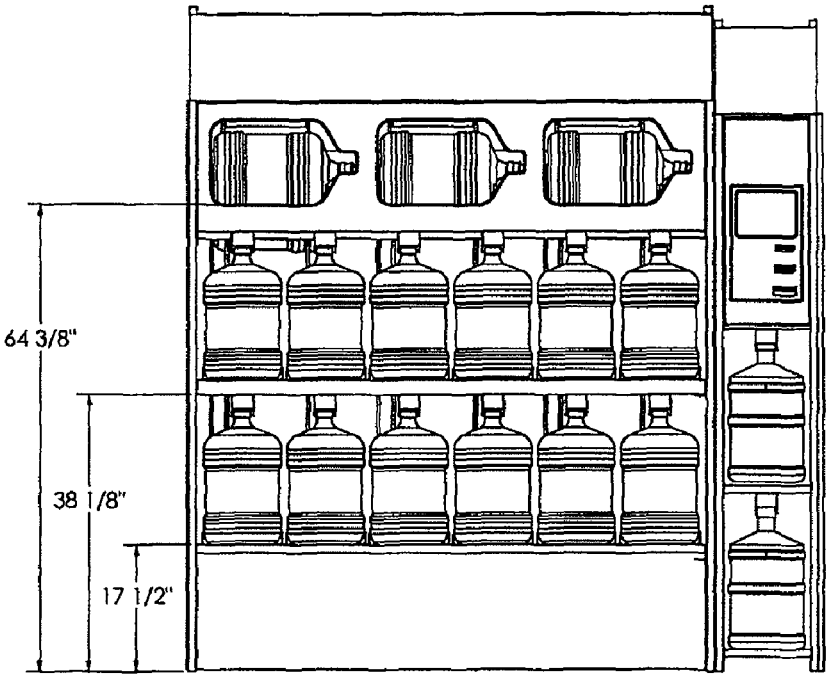
FIG. 4 is a front view of the kiosk of FIG. 1.

FIG. 1 shows a kiosk 10 having a first side or front 12, sides 14 (opposing side not shown) and back 16 as better seen in FIG. 3. The kiosk 10 preferably receives returns 18. It may also assist in dispensing a supply of stocked units 20.

The kiosk 10 preferably accepts the returns 18 initially at return station 22 which is illustrated beginning at an elevation above dispensing station 24 but may not necessarily be in all embodiments. Dispensing station 24 may not form a portion of all embodiments of kiosk 10.

The dispensing station 22 is preferably located at a sufficient elevation for at least some embodiments to allow for gravity to assist in movement of returns 18 as will be discussed in further detail below. The return station 22 is preferably provided with one or more acceptors 26 which preferably provide a perimeter 28 which can accommodate a desired return such as a water bottle or a propane bottle, etc., of a predetermined configuration and/or orientation while at least in some embodiments preferably rejecting the acceptance of other returns. Returns 18 are preferably empty bottles. For example, in the preferred embodiment the acceptors 26 accept five gallon water bottles but reject or refuse to accept two and one half or three gallon water bottles. Other embodiments may not provide for selective acceptance of returns. The return feature at acceptor 26 will be discussed in further detail in reference to FIGS. 5, 6 and 7 below particularly as it relates to the acceptance or rejection of returns.

Upon entering the return station 22, the returns 18 illustrated as bottles are preferably supported by one or more guides illustrated as bottom tracks 30,32 contacting circumference 29 of bottle side 31. In fact, cooperating guides illustrated as side tracks 34,36 are also useful with side track 34 providing a location on which dispensing end 38 of bottle illustrated return 18 may also be supported at least at some portion from below and/or provide for side support and/or direction of the return 18 at least along first stage 40 of the return system.

The first stage 40 as preferably provided utilizes gravity by having a higher elevation at first point 44 than second point 42 so that the bottles are fed at least partially by gravity towards the back 16. Other embodiments may operate differently.

Gravity feed can also assist at the second stage 46 in which side directors 48,50 and/or 52 cooperate can assist in keeping the returns 18 in alignment as they proceed downwardly towards a lower or bottom portion of the kiosk 10 such as to third stage 50. Once again, side directors 52,54 can assist in directing the returns towards the desired location. Elevation at point 56 can be higher than that at point 58 along a continuous plane 60 which could be somewhat similar to continuous plane 62 to assist in that downward direction to possibly allow gravity to at least assist in moving the returns 18 such as by rolling to their desired storage position.

Figure 2:
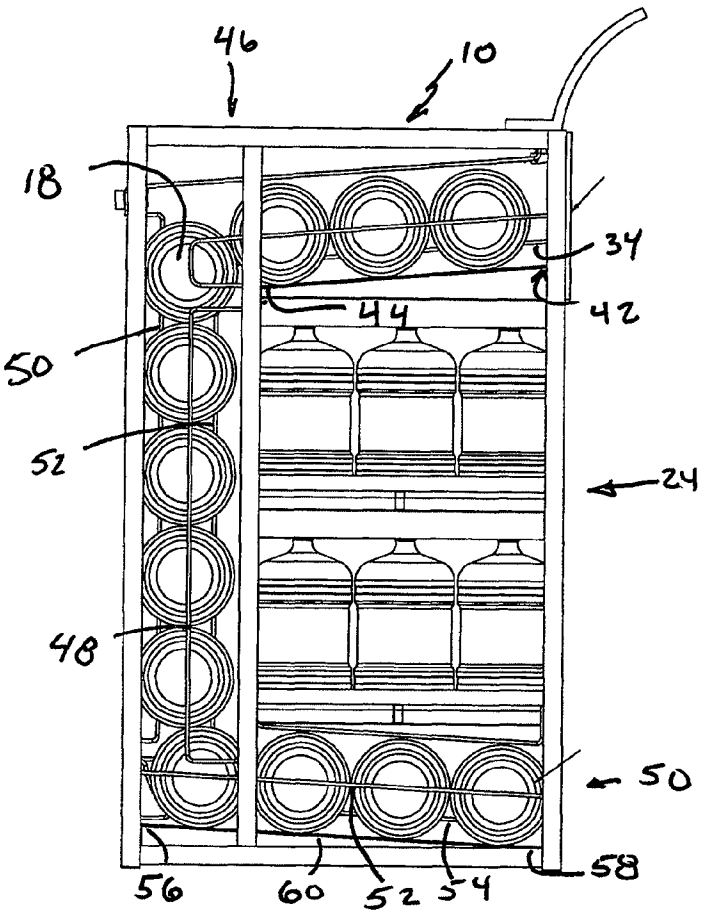
FIG. 2 is a cross sectional view taken along line A of FIG. 1.

FIG. 2 shows all twelve returns as a possible maximum number of returns 18 in one lane 19 of the return station 22 awaiting retrieval through recovery station 64. The illustrated the embodiment the return station 22 begins above the dispensing station 24 and terminates below the dispensing station 24. Dispensing station 24 may be provided with at least one row 66 illustrated, such as with six stock units across which are three in depth which can be seen by reference to FIG. 2. There are also two columns high as illustrated. Dividers 68 may be useful supplying and/or adjacent stacked units 20 in a neat organization 66 towards the bottom of opposing sides of stocked units 20. Furthermore, head receivers 70 may be useful to direct the upper portion of the bottle and possibly prevent removal of the return 20 until payment has been made at processor 72 in some modes of operation which could include a credit card input 74 and/or a ticket dispenser 76 with screen 78 along with possible other components. With such a set up as would be understood by those of ordinary skill in the art, cooperation with sensors such as in the head units 70 on or with the shelves 80,82, and or acceptor(s) 26, the processor 72 could assist in receiving and/or dispensing. The processor 72 could also predict anticipated locations of the stocked units 20 such as the stocking configurations shown in FIGS. 1 and 2. Processor 72 can detect the location of stocked units 20 at the dispensing station 24 at least for some embodiments. Processor may also detect a return 18 possibly through acceptor(s) 26. Additionally, side station 84 may provide one or more additional locations for stock units 86,88 as well as additional stocked units 90 as shown in FIG. 3 which may or may not be accessible to a customer. An operator may be required to move stock units 90 to dispensing station 24 to be stock units 20.

The return station 22 may also be equipped with sensors to advise the processor 72 of whether or not an empty has been returned to the kiosk 10 based on whether or not an empty has been returned or not. This may affect pricing of stock units 20 at processor 72 in some modes of operation.

Back 16 shows various components in FIG. 3.

The return station 22 preferably receives from the first lane 19 and second lane 21 and the lane 23 but all station lanes 19,21,23 need not be utilized in all embodiments. Furthermore, additional lanes 19,21,23 could be provided in other embodiments. The first stage 96 may provide gradual and/or sequential acceptance of an empty return 18 and direct return 18 towards second stage 48 at which the empty can descend down towards the third stage 50 which is where an operator may relatively easily remove the empties from a station 64 when in a removal configuration. Second stage 48 is illustrated at a steeper grade of descent than first and second stages 46,50 in this embodiment. Other embodiments may differ. The first stage 46 is shown as extending a distance above the receiving station, the second stage 48 extends fully behind the dispensing station 24 and the third stage 50 is shown completely below the dispensing station 24 in the preferred embodiment. Other embodiments may have other configurations in an accept configuration.

Figure 5:
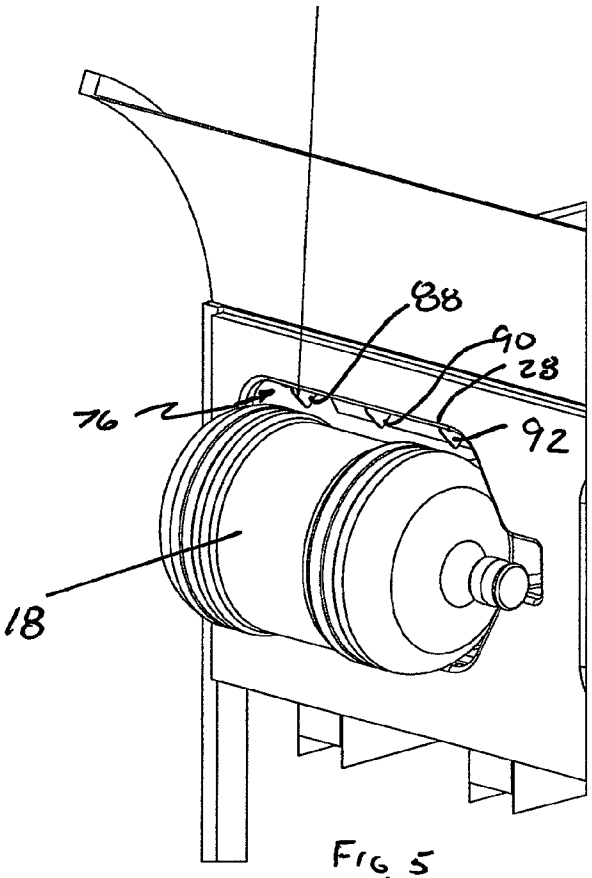
FIG. 5 is a detailed view of detail B shown in FIG. 1.

FIG. 5 shows the receipt of a return 18 in accordance with a preferred embodiment of the present invention. Specifically, return 18 is directed through acceptor 26 having perimeter 28. If the return 18 has a cross section configuration which will not cooperate with the perimeter 28 at a desired orientation, then the return will be rejected. Furthermore, stop mechanism 86 may include a plurality of stop latches 88,90,92. In the preferred embodiment, all the stop latches 88,90,92 must contact the return 18 such as with the contacts 94 on exterior surface 96 such as simultaneously or otherwise for the rotation of the latches 88,90,92 about one or more pivots 98 so that catches 100 disengage stop plate 102 to allow for the return 18 to pass through acceptor(s) 26 by stop mechanism 86 so that it is no longer blocked by stop plate 102.

In the illustrated embodiment, the stop mechanism 86 allows for the acceptance of five gallon jugs to be provided in the correct orientation. Preferably, all three stop latches 88,90,92 must be engaged to allow for the stop plate 102 to move to a receive or accept configuration from a blocking configuration. Other embodiments may function differently. Three gallon jugs and/or bottles turned the wrong way will not engage all of the stop latches 88,90,92 and thus will not allow such a return to pass through the acceptor 26 even if they could fit through perimeter 28.

Figure 6:
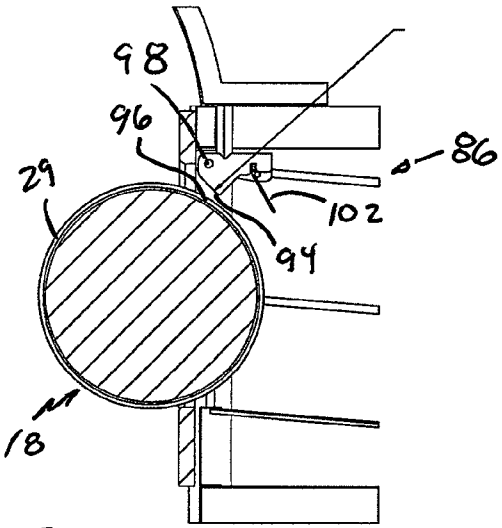
FIG. 6 is a cross sectional view taken along the line C-C of FIG. 5 as a return bottle shown in FIG. 5 is inserted into the initial receiving station.
Figure 7:
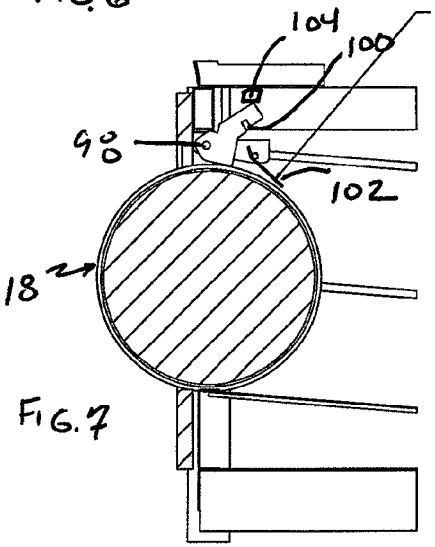
FIG. 7 shows the bottle as shown in FIGS. 5 and 6 moving past a latch interlock thereby accepting a return bottle.

As shown in FIG. 6, a return which initially contacts the contact 94 allows for a latch 92 to rotate about pivot 98 to then allow the stop plate 102 to move as described above. With the processor 72 provided with a signal from a switch such as switch 104 which is electrical communication with the controller 72, a signal can be provided to processor 72 and/or a computer therefore advising of the successful receipt of a return 18. Once the return 18 passes past the stop plate 102, and/or the stop plate 86 and/or the stop latches 88,90,92 the stop latches 88,90,92 and/or others can reset along with the stop plate 102 therefore preventing the returns 20 from being removed and being ready to block again in the blocking configuration. Returns 18 progress to be sequentially stored at recovery station which provides for access in a recovery configuration by an operator. Door 65 can be opened to allow access. After recovery, the door 65 can be shut and/or locked in some embodiments in an in-use configuration.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A bottle kiosk, comprising:

a return station having an acceptor that receives empty bottles as returns, the acceptor being configured to accept returns having a first predetermined dimension and refuse to accept returns having a second predetermined dimension;

a recovery station positioned below the acceptor, the return station having guides that direct returns received at the acceptor to the recovery station in sequential order as received at the acceptor with a circumference of a bottle side of individual returns contacting one or more of the guides, the recovery station providing access for an operator to remove the returns in a retrieve configuration; and wherein the return station has a plurality of latches located at the acceptor, wherein the latches must contact a portion of the circumference of the individual returns to allow the returns to pass by the acceptor and proceed toward the recovery station.

2. The bottle kiosk of claim 1 further comprising a stop plate, and the latches have a catch initially restraining movement of the stop plate in a blocking configuration, and upon contacting predetermined portions of the circumference of the return, said catches release from the stop plate thereby allowing movement of the stop plate to an accept configuration, and once the return passes by the latches and stop plate, the catches re-engage the stop plate thereby restoring the stop plate to the blocking configuration.

3. The bottle kiosk of claim 1, further comprising an acceptor perimeter, said acceptor perimeter selected to cooperate with a predetermined return cross sectional shape, thereby requiring a predetermined orientation of the return into the acceptor.

4. The bottle kiosk of claim 1, further comprising cooperating guides which direct the return in a pre-determined path intermediate the acceptor and the recovery station while allowing the return to roll on a circumference of a side surface on the guides.

5. The bottle kiosk of claim 1 wherein the acceptor is accessible from a first side of the kiosk, and the recovery station is also accessible from the first side when in a retrieve configuration to remove bottles from the recovery station.

6. The bottle kiosk of claim 5 wherein the return station further comprises a first stage extending from the first side of the kiosk toward the back of the kiosk and a third stage extending from toward the back to the recovery station at the first side of the kiosk with a second stage directing the returns intermediate the first and third stages.

7. A bottle kiosk, comprising:

a return station having an acceptor that receives empty bottles as returns, the acceptor being configured to accept returns having a first predetermined dimension and refuse to accept returns having a second predetermined dimension, wherein the acceptor is accessible from a first side of the kiosk;

a recovery station positioned below the acceptor, the recovery station providing access by an operator from the first side of the kiosk to remove returns from the recovery station when the kiosk is in a retrieve configuration and denying access to the recovery station when the kiosk is in an in-use configuration, wherein the return station has guides that direct returns received at the acceptor to the recovery station in sequential order as received at the acceptor with a circumference of a bottle side of individual returns contacting one or more of the guides, the return station having a first stage extending from the first side of the kiosk toward a second side of the kiosk opposite the first side, a third stage extending from the second side toward the recovery station at the first side of the kiosk, and a second stage directing the returns from the first stage to the third stage; and a dispensing station positioned intermediate the first and third stages of the return station and in front of the second stage of the return station, wherein the dispensing station is configured to store stock units of full bottles for purchase.

8. The bottle kiosk of claim 7 further comprising a processor, said processor at least assisting in coordinating the dispensing of full bottles from the dispensing station and accepting of returns through the return station.

9. The bottle kiosk of claim 5 wherein the recovery station has a storage configuration wherein the access to returns is denied when in the storage configuration.

10. A bottle kiosk, comprising:

a return station having an acceptor that receives empty bottles as returns, wherein the acceptor is accessible from a first side of the kiosk, wherein the acceptor accepts returns of a pre-determined cross section configuration with at least one stop plate restricted from movement by latches, and wherein said latches are movable from a blocking configuration by contact with individual returns having the pre-determined configuration;

a recovery station positioned below the acceptor, the return station having guides that direct returns received at the acceptor to the recovery station with a circumference of a bottle side of individual returns contacting one or more of the guides, wherein the return station includes a first stage for receiving returns at the acceptor, a third stage directing returns to the recovery station, and a second stage at least assisting in directing the returns from the first stage to the third stage; and a dispensing station accessible from the first side of the kiosk, the dispensing station positioned intermediate the first and third stages and in front of the second stage at the first side of the kiosk.

11. The bottle kiosk of claim 10 further comprising a processor, said processor at least assisting in dispensing a full bottle after receiving a return in a first mode.

12. A bottle kiosk comprising:

a return station, said return station having an acceptor receiving empty bottles;

a recovery station positioned below the acceptor, the return station having guides which direct bottles received at the acceptor to the recovery station with a circumference of a bottle side contacting one or more of the guides, wherein the guides direct empty bottles from the acceptor towards a back of the kiosk and downwardly to the recovery station; and wherein the return station has a plurality of latches located at the acceptor, wherein the latches contact a portion of the circumference of individual bottles to allow the bottles to pass by the acceptor and proceed toward the recovery station, and wherein the acceptor accepts bottles of a predetermined cross section configuration while blocking bottles having cross section configurations different from the predetermined cross section configuration.

13. The bottle kiosk of claim 12 wherein the return station further comprises a first track directing returns toward the back, a third track directing returns towards the front to the return station, and a second track at least assisting in directing returns sequentially from the first to the third tracks.

14. The bottle kiosk of claim 13 further comprising a dispensing station intermediate the first and third tracks and in front of the second track.

15. The bottle kiosk of claim 14 further comprising a processor, said processor receiving a signal from the return station upon receiving a return through the acceptor.

16. The bottle kiosk of claim 12 wherein the return station further includes a stop plate for blocking bottles having cross section configurations different from the pre-determined cross section configuration.

* * * * *